US010358313B2

(12) United States Patent
Nobe et al.

(10) Patent No.: US 10,358,313 B2
(45) Date of Patent: Jul. 23, 2019

(54) SHEET PROCESSING DEVICE AND IMAGE FORMING SYSTEM

(71) Applicant: FUJI XEROX CO., LTD., Tokyo (JP)

(72) Inventors: Yutaka Nobe, Kanagawa (JP); Satoshi Kurihara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 106 days.

(21) Appl. No.: 15/602,913

(22) Filed: May 23, 2017

(65) Prior Publication Data

US 2018/0016110 A1 Jan. 18, 2018

(30) Foreign Application Priority Data

| | | |
|---|---|---|
| Jul. 14, 2016 | (JP) | 2016-139807 |
| Jul. 14, 2016 | (JP) | 2016-139808 |
| Jul. 14, 2016 | (JP) | 2016-139809 |
| Jul. 14, 2016 | (JP) | 2016-139810 |
| Nov. 14, 2016 | (JP) | 2016-221512 |

(51) Int. Cl.
*G03G 15/00* (2006.01)
*B65H 37/04* (2006.01)

(52) U.S. Cl.
CPC ..... *B65H 37/04* (2013.01); *G03G 15/6541* (2013.01); *G03G 15/6544* (2013.01); *B65H 2301/51616* (2013.01); *B65H 2801/27* (2013.01)

(58) Field of Classification Search
CPC ..... G03G 2215/00852; B65H 2301/51616
See application file for complete search history.

(56) References Cited

U.S. PATENT DOCUMENTS

| | | | | |
|---|---|---|---|---|
| 2015/0093214 | A1* | 4/2015 | Takahashi | B42B 5/00 412/33 |
| 2016/0376121 | A1* | 12/2016 | Komiyama | B65H 37/04 270/1.01 |
| 2017/0275128 | A1* | 9/2017 | Makita | B65H 37/04 |

FOREIGN PATENT DOCUMENTS

| | | | |
|---|---|---|---|
| JP | 07047783 A | * | 2/1995 |
| JP | 2011-201653 A | | 10/2011 |

* cited by examiner

*Primary Examiner* — Jennifer E Simmons
(74) *Attorney, Agent, or Firm* — Sughrue Mion, PLLC

(57) ABSTRACT

A sheet processing device includes a binding mechanism that has two pivot members opposed to each other to pivot on a pivot and binds sheets with a pressure by clamping the sheets between the two pivot members, a transmission member that transmits a force to pivot the two pivot members, and an intermediate member that transmits, to the binding mechanism, the force from the transmission member as the pressure with which the two pivot members clamp the sheets. When the intermediate member is in contact with the transmission member to transmit the force from the transmission member to the binding mechanism, the transmission member is held between the intermediate member and a shaft member provided at the pivot of the binding mechanism.

14 Claims, 12 Drawing Sheets

SHEET PROCESSING DEVICE AND IMAGE FORMING SYSTEM

CROSS-REFERENCE TO RELATED APPLICATIONS

This application is based on and claims priority under 35 USC 119 from Japanese Patent Application No. 2016-139807 filed Jul. 14, 2016, No. 2016-139808 filed Jul. 14, 2016, No. 2016-139809 filed Jul. 14, 2016, No. 2016-139810 filed Jul. 14, 2016, and No. 2016-221512 filed Nov. 14, 2016.

BACKGROUND

Technical Field

The present invention relates to a sheet processing device and an image forming system.

SUMMARY

According to an aspect of the invention, there is provided a sheet processing device including a binding mechanism that has two pivot members opposed to each other to pivot on a pivot and binds sheets with a pressure by clamping the sheets between the two pivot members, a transmission member that transmits a force to pivot the two pivot members, and an intermediate member that transmits, to the binding mechanism, the force from the transmission member as the pressure with which the two pivot members clamp the sheets, wherein, when the intermediate member is in contact with the transmission member to transmit the force from the transmission member to the binding mechanism, the transmission member is held between the intermediate member and a shaft member provided at the pivot of the binding mechanism.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

[Description of Image Forming System]

Figure 1:
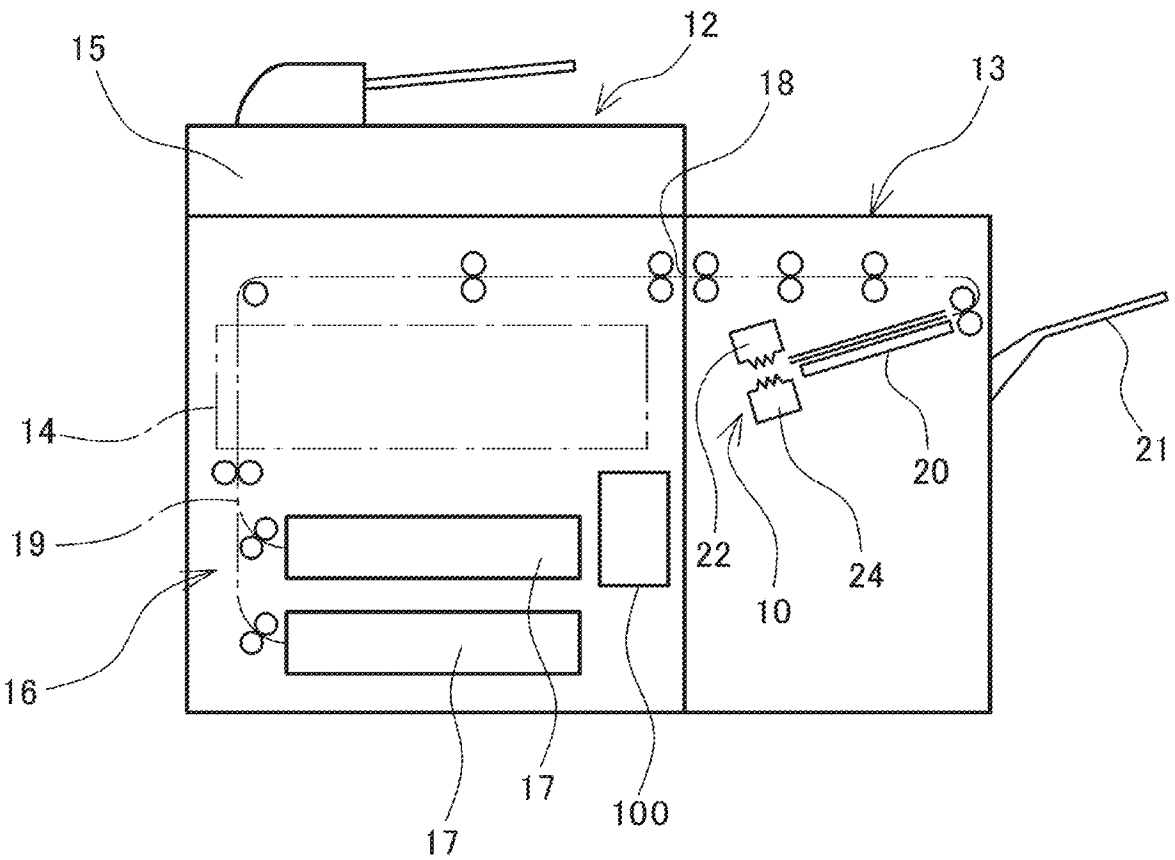
FIG. 1 illustrates an image forming system according to an exemplary embodiment of the present invention.

FIG. 1 is a schematic view illustrating a general configuration of an image forming system 11 including a recording-material binding device 10 serving as a recording-material processing device according to the exemplary embodiment. The image forming system 11 includes an image forming apparatus 12 having a printing function and a copying function using, for example, electrophotography, and a recording-material post-processing apparatus 13 that conducts post processing, for example, punching and binding, on recording materials after images are formed thereon in the image forming apparatus 12. The recording-material binding device 10 of the exemplary embodiment may be installed in the recording-material post-processing apparatus 13.

The image forming apparatus 12 includes an image forming section 14 that forms a toner image on the basis of acquired document information. The document information may be acquired by reading a document with a document reading unit 15 provided in the image forming apparatus 12, or may be acquired from an external apparatus. The image forming apparatus 12 further includes a recording-material feeding mechanism 16. Recording materials to be fed are sheet-like recording materials cut in a rectangular shape, and are made of, for example, paper. The recording-material feeding mechanism 16 includes supply trays 17 that hold stacked recording materials, and a transport path 19 through which the recording materials are transported from the supply trays 17 to an output port 18. In a process of being transported through the transport path 19, a recording material receives a toner image formed in the image forming section 14, and the toner image is fixed thereon. The recording material sent out from the output port 18 is received by the recording-material post-processing apparatus 13.

In the recording-material post-processing apparatus 13, received recording materials are stacked on an accumulation tray 20 to form a recording material bundle, as required. When accumulation is unnecessary, the recording materials are output into an output tray 21. When a predetermined number of recording materials are accumulated on the accumulation tray 20, they are bound by the recording-material binding device 10. The recording-material binding device 10 includes a pair of two tooth-shaped members 22 and 24 in each of which plural teeth are arrayed. To distinguish the two tooth-shaped members, for convenience, the tooth-shaped member located on an upper side of FIG. 1 is referred to as an upper tooth-shaped member 22, and the tooth-shaped member located on a lower side of FIG. 1 is referred to as a lower tooth-shaped member 24. It is only required that the two tooth-shaped members 22 and 24 should be opposed to each other with recording materials to be bound being interposed therebetween, and, for example, the tooth-shaped members may be arranged in the right-left direction.

Both or one of the upper tooth-shaped member 22 and the lower tooth-shaped member 24 is advanced or retreated relative to the other tooth-shaped member by a driving mechanism. When both or one of the upper tooth-shaped member 22 and the lower tooth-shaped member 24 advances, the upper tooth-shaped member 22 and the lower tooth-shaped member 24 bite each other. When the upper tooth-shaped member 22 and the lower tooth-shaped member 24 bite each other, recording materials clamped therebetween are deformed in a wavy form, joined, and bound. After bound, a bundle of the recording materials is output to the output tray 21.

The image forming system 11 further includes a controller 100 that controls operations of parts and mechanisms in the image forming apparatus 12 and the recording-material post-processing apparatus 13.

[Outward Appearance of Recording-Material Binding Device]

Figure 2:
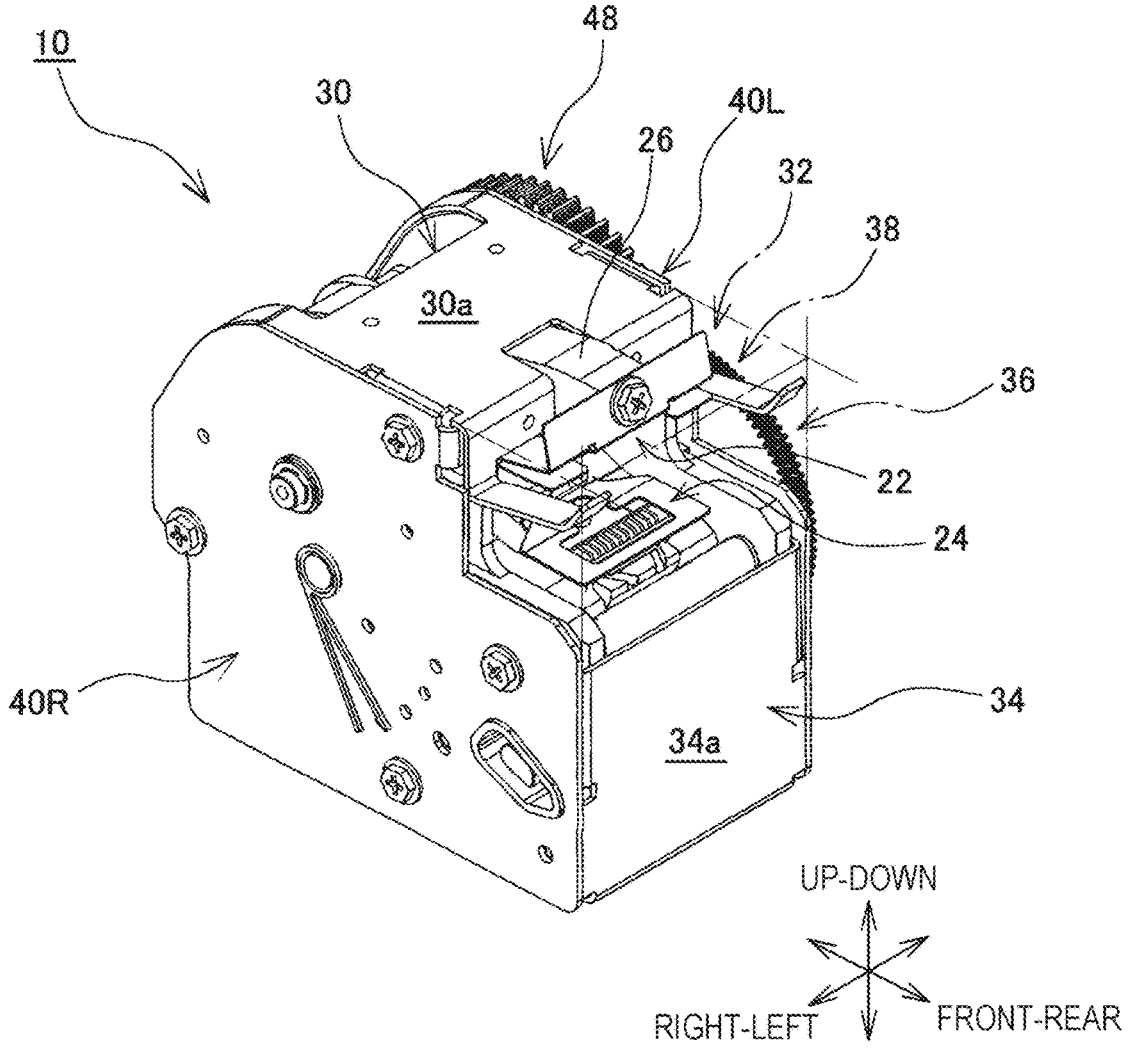
FIG. 2 is a perspective view illustrating an outward appearance of a recording-material binding device.

FIG. 2 is a perspective view illustrating an outward appearance of the recording-material binding device 10. The recording-material binding device 10 has an outer shape like a substantially rectangular parallelepiped. For plain explanation, front-rear, up-down, and right-left directions orthogonal to one another are determined in accordance with extending directions of sides of the rectangular parallelepiped. The up-down direction nearly coincides with a direction in which the upper tooth-shaped member 22 and the lower tooth-shaped member 24 are opposed to each other, and the front-rear direction nearly coincides with an extending direction of an upper arm 26 and a lower arm 28 (see FIG. 3) to which the upper tooth-shaped member 22 and the lower tooth-shaped member 24 are respectively attached. The upper tooth-shaped member 22 and the lower tooth-shaped member 24 are disposed in an upper front corner region 38 near a corner of the rectangular parallelepiped that defines the outer shape of the recording-material binding device 10 where a device upper surface 32 and a device front surface 36 intersect. The device upper surface 32 is defined by an upper surface plate 30*a* of an upper frame 30 of the rectangular parallelepiped, and the device front surface 36 is defined by a front surface plate 34*a* of a front frame 34 of the rectangular parallelepiped. In this upper front corner region 38, recording materials are clamped and bound by the upper and lower tooth-shaped members 22 and 24. The upper tooth-shaped member 22 corresponds to an example of a first member, and the lower tooth-shaped member 24 corresponds to an example of a second member. Left and right sides of the recording-material binding device 10 are mostly covered with two side frames, namely, a left side frame 40L and a right side frame 40R.

Figure 3:
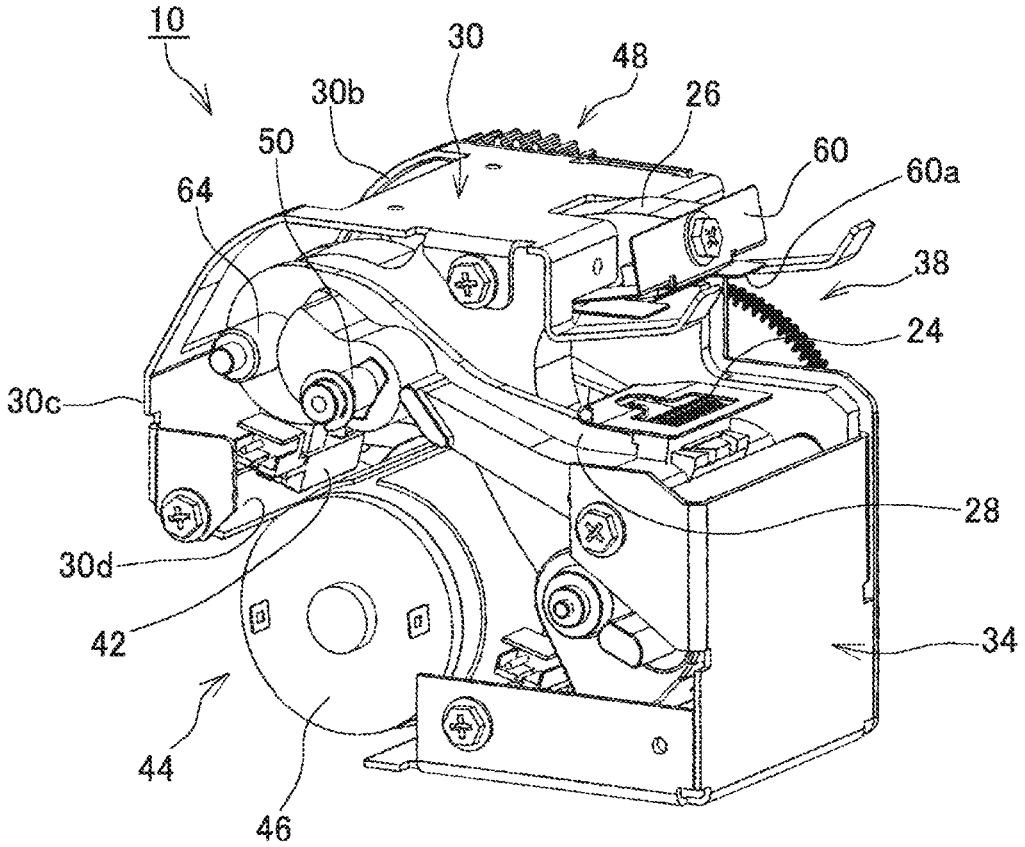
FIG. 3 is a perspective view illustrating the inside of the recording-material binding device.

FIG. 3 is a perspective view of the recording-material binding device 10 from which the right side frame 40R is removed so that the inside is seen. The upper frame 30 includes a rear surface plate 30*c* having an opening 30*b* and a support plate 30*d* extending frontward from a lower edge of the rear surface plate 30*c*. The rear surface plate 30*c* is curved at a portion where the opening 30*b* is provided. Thus, the outer shape of the recording-material binding device 10 is round-chamfered in an upper rear corner region. A home position sensor 42 is provided on the support plate 30*d*. The home position sensor 42 detects the home position of a binding operation unit to be described later. Detection of the home position will be described in conjunction with the operation of the binding operation unit.

A motor 46 is disposed at a position diagonal to the upper front corner region 38, that is, in a lower rear corner region 44. The motor 46 has a motor pinion 46*a* (see FIG. 5) on an output shaft, and the motor pinion 46*a* is meshed with one gear in a gear train 48 disposed on an outer side of the left side frame 40L. The gear train 48 constitutes a reduction gear train, and the motor 46 rotates a cam shaft 50 through the gear train 48.

Figure 4:
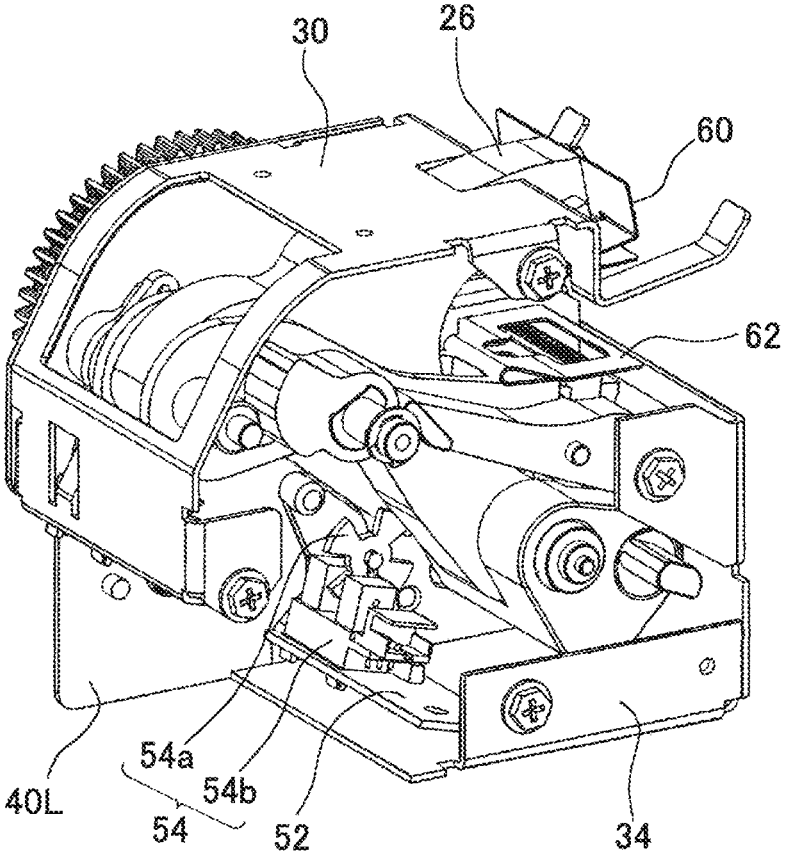
FIG. 4 is a perspective view illustrating the inside of the recording-material binding device.

FIG. 4 is a perspective view of the recording-material binding device 10 from which the motor 46 is also removed from the state of FIG. 3. An encoder bracket 52 is fixed to the left side frame 40L, and an encoder 54 for detecting the rotation angle of the motor 46 is disposed on the encoder bracket 52. The encoder 54 includes a rotor 54*a* rotatably supported by the encoder bracket 52, and a photosensor 54*b* fixed to the encoder bracket 52. The rotor 54*a* is shaped like an impeller having a rotation shaft, and an encoder pinion 54*c* is provided at an end of the rotation shaft. The encoder pinion 54*c* is meshed with one gear 48*a* in the gear train 48 (see FIG. 5). When the motor 46 rotates, the rotor 54*a* also rotates. The gear 48*a* with which the encoder pinion 54*c* is meshed may be a first stage gear of the gear train 48. The photosensor 54*b* has two opposed portions, and detects passage of blades of the rotor 54*a* between the opposed portions. By counting the number of passages of the blades, the rotation angle of the output shaft of the motor 46 is detected. The photosensor 54*b* may be replaced with a sensor that detects the passage of the blades of the rotor 54*a*.

Figure 5:
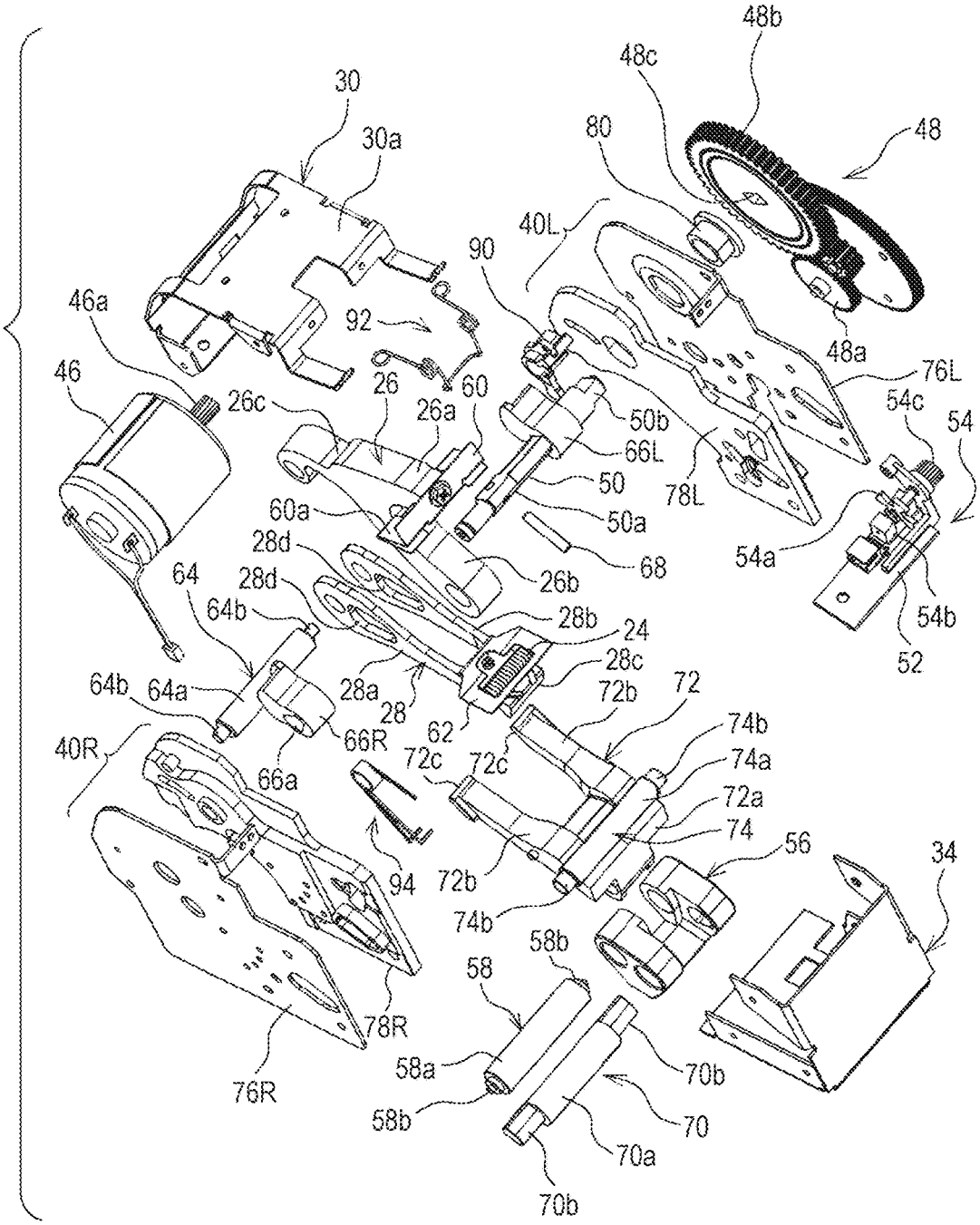
FIG. 5 is an exploded perspective view of the recording-material binding device.
Figure 6:
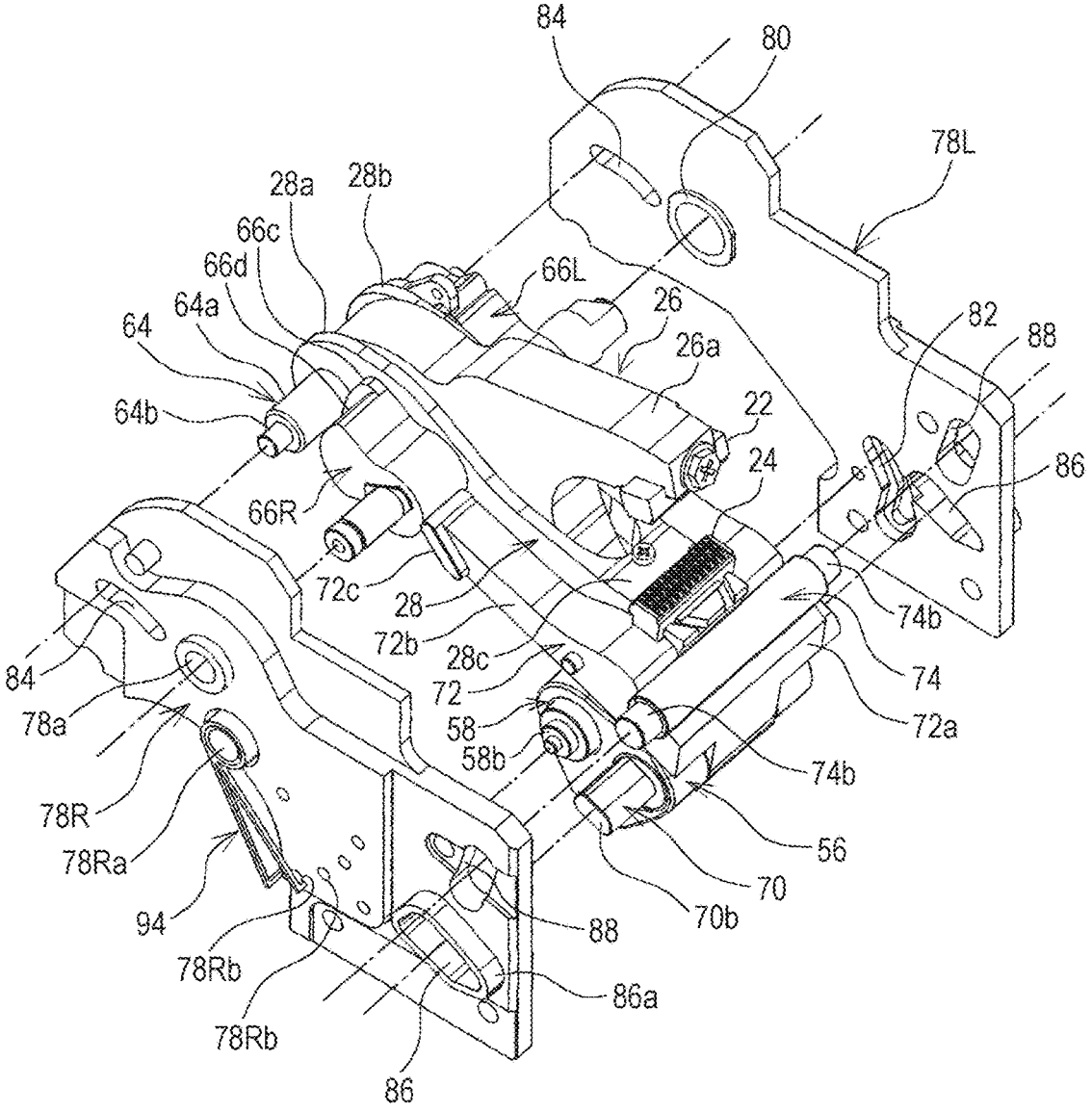
FIG. 6 is a perspective view illustrating the principal part of a binding operation unit.
Figure 7:
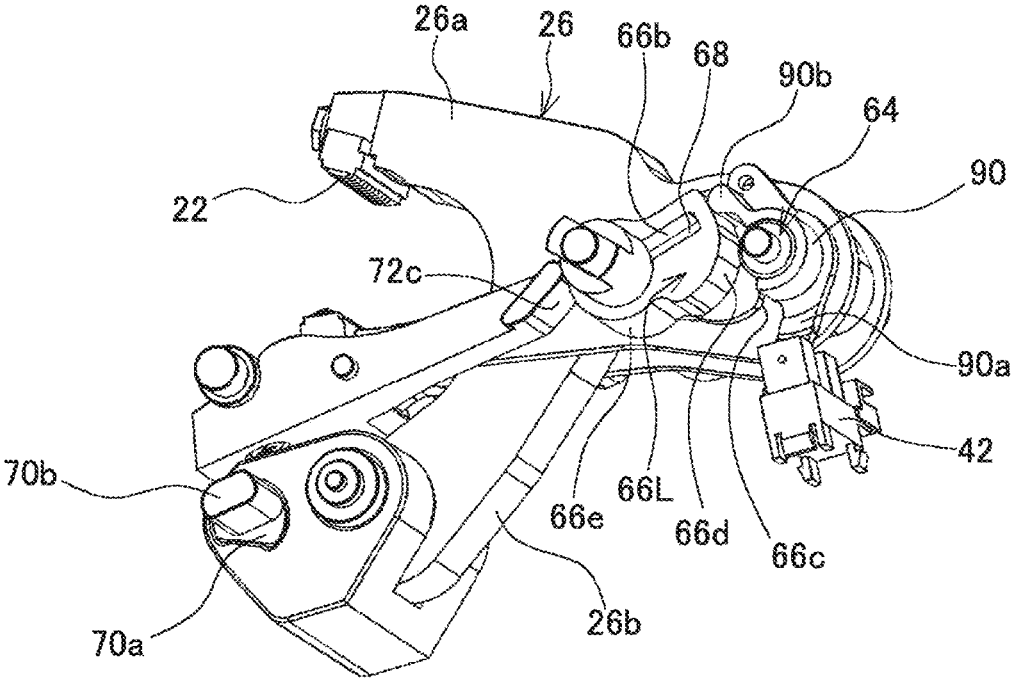
FIG. 7 is a perspective view illustrating the principal part of the binding operation unit.

FIG. 5 is an exploded view of the recording-material binding device 10, and FIGS. 6 and 7 illustrate the principal part of the binding operation unit. The binding operation unit is constituted of the above-described upper and lower arms 26 and 28, a lever link 56 and a support lever 72 to be described later, and a connecting pin 58, an arm pin 64, and a guide pin 70 for coupling these elements. The binding operation unit corresponds to an example of a binding mechanism.

The upper arm 26 includes an arm portion 26*a* extending in a substantially frontward direction and having a distal end portion to which the upper tooth-shaped member 22 is attached, and a connecting portion 26*b* branching from the arm portion 26*a* and extending downward to be connected to a lever link 56. The connecting portion 26*b* and the lever link 56 are connected by a connecting pin 58 to be turnable on the connecting pin 58. To a distal end portion of the upper arm 26, an upper guide plate 60 is attached to be located near the upper tooth-shaped member 22. Portions of the upper guide plate 60 located on the right and left of the upper tooth-shaped member 22 have V-shaped portions 60*a* formed by bending a steel plate, such as a spring steel plate, and opening frontward. The V-shaped portions 60*a* are closed when recording materials are bound, and the bound recording materials are separated from the upper tooth-shaped member 22 by an elastic opening force of the V-shaped portions 60*a*. The connecting pin 58 has a columnar shaft portion 58*a* and guide projections 58*b* projecting from both ends of the shaft portion 58*a*.

The lower arm 28 includes two arm plates 28*a* and 28*b* spaced from each other and extending frontward, and a distal end base 28*c* disposed at distal ends of the arm plates 28*a* and 28*b* to connect the arm plates 28*a* and 28*b*. The lower tooth-shaped member 24 is mounted on the distal end base 28*c*. A lower guide plate 62 is disposed to surround the lower tooth-shaped member 24. The lower guide plate 62 is V-shaped to open frontward by bending a steel plate such as a spring steel plate. When recording materials are bound, the V-shaped lower guide plate 62 is closed, and the bound recording materials are separated from the lower tooth-shaped member 24 by an elastic opening force of the V-shaped lower guide plate 62.

The upper arm 26 and the lower arm 28 are connected at rear ends thereof by an arm pin 64 to be independently turnable. When connected, the upper arm 26 is located between the two arm plates 28*a* and 28*b* of the lower arm 28. When the upper arm 26 and the lower arm 28 turn on the arm pin 64, the upper tooth-shaped member 22 and the lower tooth-shaped member 24 move close to each other, and move away from each other. The arm pin 64 has a columnar shaft portion 64*a* and guide projections 64*b* projecting from both ends of the shaft portion 64*a*.

The two arm plates 28*a* and 28*b* of the lower arm 28 have their respective openings 28*d* through which the cam shaft 50 extends. To the cam shaft 50, two driving cams, that is, a left driving cam 66L and a right driving cam 66R are fixed to be located on the left and right of the upper arm 26 and the lower arm 28 when assembled. At two positions on the cam shaft 50, modified-section shaft portions 50*a* having a cross section other than a circular cross section, for example, a fan-shaped cross section from which a center portion is removed are provided. The left and right driving cams 66L and 66R have modified-section holes 66*a* that conform to this cross sectional shape. Fixing pins 68 stand on the modified-section shaft portions 50*a* of the cam shaft 50 in a direction intersecting the axis, or penetrate the modified-section shaft portions 50*a*. The left and right driving cams 66L and 66R have pin receiving grooves 66*b* for receiving the fixing pins 68 (see FIG. 7). The left and right driving cams 66L and 66R are fixed to the cam shaft 50 in the rotating direction by engaging with the modified-section shaft portions 50*a* and the fixing pins 68 of the cam shaft 50. The left and right driving cams 66L and 66R are more firmly fixed in the rotating direction by engaging not only with the modified-section shaft portions 50*a* but also with the fixing pins 68.

A fitting portion 50*b* having two parallel flat faces is provided at a left end of the cam shaft 50. The fitting portion 50*b* is fitted in one gear of the gear train 48, for example, a fitting hole 48*c* provided in the last stage gear 48*b* in the gear train 48. This fitting allows the cam shaft 50 to be rotated by the motor 46 through the gear train 48.

The lever link 56 is further coupled to a support lever 72 by a guide pin 70. The guide pin 70 has a shaft portion 70*a* and guide projections 70*b* extending from both ends of the shaft portion 70*a*. The shaft portion 70*a* has a noncircular cross-sectional shape, for example, a noncircular cross-sectional shape defined by one chord of a circle and a larger one of arcs divided by this chord, as illustrated in FIG. 7. Holes of the lever link 56 for receiving the guide pin 70 have such a shape as to fit the shaft portion 70*a* of the guide pin 70. Thus, the guide pin 70 is fixed to the lever link 56 in the rotating direction.

When recording materials are bound, the support lever 72 supports the distal end base 28*c* of the lower arm 28 from below, and receives a reaction force of the binding operation. The support lever 72 includes a support 72*a* located below the distal end base 28*c* of the lower arm 28 when the recording materials are bound, and two lever portions 72*b* extending rearward from the support 72*a* outside the lower arm 28. A support bar 74 is fixed on the support 72*a*. The support bar 74 has a columnar shaft portion 74*a* and guide projections 74*b* projecting from both ends of the shaft portion 74*a*. At rear ends of the two lever portions 72*b*, cam followers 72*c* are provided to be in contact with the left and right driving cams 66L and 66R.

The left side frame 40L has a left side panel 76L and a left guide plate 78L. When assembled, the left side panel 76L and the left guide plate 78L are superposed into one. The right side frame 40R has a right side panel 76R and a right guide plate 78R. When assembled, the right side panel 76R and the right guide plate 78R are superposed into one.

The cam shaft 50 is rotatably supported by the left and right side frames 40L and 40R by being passed through a bearing bush 80 attached to the left side frame 40L and a bearing hole 78*a* provided in the right guide plate 78R.

The left and right guide plates 78L and 78R respectively have guide grooves 82, 84, and 88 and guide holes 86 for guiding movements of the connecting pin 58, the arm pin 64, the guide pin 70, and the support bar 74.

The guide projections 58*b* provided at both ends of the connecting pin 58 are fitted in left and right connecting-pin guide grooves 82. The guide projections 58*b* have a stepped columnar shape. Correspondingly thereto, the connecting-pin guide grooves 82 have such a stepped groove shape as to be deep in a center portion thereof and to be shallow near an edge thereof. The connecting-pin guide grooves 82 have their respective bottoms, and are not open to outer surfaces of the left and right guide plates 78L and 78R. The connecting-pin guide grooves 82 are bent, but extend in a substantially up-down direction.

The guide projections 64*b* provided at both ends of the arm pin 64 are fitted in arm-pin guide grooves 84. The arm-pin guide grooves 84 extend in a substantially front-rear direction, and guide frontward and rearward movements of the upper arm 26 and the lower arm 28. The arm-pin guide grooves 84 extend through the entire thickness of the left and right guide plates 78L and 78R.

The guide projections 70*b* provided at both ends of the guide pin 70 are put in guide holes 86. The guide projections 70*b* have a modified cross-sectional shape nearly like an oval. The cross-sectional shape of the guide holes 86 is substantially trapezoidal, and the guide holes 86 are larger than the guide projections 70*b* as a whole. For this reason, upward, downward, frontward, and rearward movements of the guide projections 70*b* are permitted within the guide holes 86. The dimension of the guide holes 86 in the right-left direction is extended by extension walls 86*a* standing on the outer side surfaces of the left and right guide plates 78L and 78R.

At both ends of the support bar 74 provided integrally with the support lever 72, the columnar guide projections 74*b* are provided, and are fitted in support-lever guide grooves 88. The support-lever guide grooves 88 extend in a substantially up-down direction, and guide the movement of the support lever 72, particularly, the support 72*a* in the up-down direction. The support-lever guide grooves 88 extend through the entire thickness of the left and right guide plates 78L and 78R.

The left and right driving cams 66L and 66R respectively have first cam faces 66*c* in contact with the arm pin 64 and second cam faces 66*d* in contact with the cam followers 72*c* provided in the support lever 72 (see FIG. 7). The first cam faces 66*c* and the second cam faces 66*d* project from cam base bottom faces 66*e* constituted by parts of cylindrical surfaces having an axis common to the cam shaft 50. The first cam faces 66*c* project more than the second cam faces 66*d*.

As illustrated in FIG. 7, a home-position detector 90 is attached to a left end portion of the arm pin 64 to be turnable on the arm pin 64. The home-position detector 90 has a detection piece 90*a* serving as a detection object for the home position sensor 42 and a cam follower 90*b* in contact with the second cam face 66*d* of the left driving cam 66L. As the left driving cam 66L turns, the home-position detector 90 pivots, and the detection piece 90*a* advances or retreats relative to the home position sensor 42. A photosensor may be used as the home position sensor 42. When the detection piece 90*a* is put between two portions of the home position sensor 42, the home position of the binding operation unit is detected.

Figure 8:
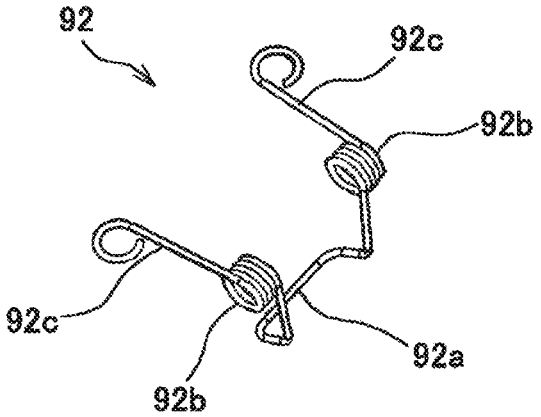
FIG. 8 is a perspective view of a push-out spring.

FIG. 8 illustrates a push-out spring 92 (corresponding to an example of a spring). The push-out spring 92 abuts on the upper arm 26, and biases the entire binding operation unit to the lower front side. The push-out spring 92 has an operating portion 92*a* to abut on a spring receiving face 26*c* (see FIG. 5) provided on a slightly rear portion of an upper part of the upper arm 26. The operating portion 92*a* has a substantially U-shape, and fixed portions 92*c* are connected to the operating portion 92*a* with coil portions 92*b* at both ends being interposed therebetween. The fixed portions 92*c* are fixed to an inner surface of the upper surface plate 30*a* of the upper frame 30, and the operating portion 92*a* is turnable on the coil portions 92*b*. The push-out spring 92 biases the entire binding operation unit to push out the binding operation unit to the lower front side.

Figure 9:
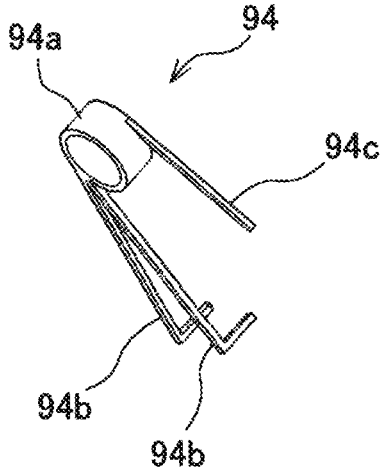
FIG. 9 is a perspective view of a support spring.

FIG. 9 illustrates a support spring 94. The support spring 94 supports the support lever 72 so that the positions of the cam followers 72*c* of the support lever 72 are not excessively lowered when the support lever 72 is separate from the driving cams 66L and 66R. Since the support spring 94 supports the support lever 72, when the driving cams 66L and 66R turn, the second cam faces 66*d* come into contact with the cam followers 72*c*. A cylindrical coil portion 94*a* of the support spring 94 is attached to a boss 78Ra of the right guide plate 78R (see FIG. 6). Bent distal ends of fixed arms 94*b* extending from the coil portion 94*a* are engaged with engaging holes 78Rb provided in an outer side surface of the right guide plate 78R, and the support spring 94 is thereby fixed in the rotating direction. A support arm 94*c* of the support spring 94 extends from the coil portion 94*a* along an inner surface of the right guide plate 78R. A distal end of the support arm 94*c* supports a lower surface of one of the lever portions 72*b* in the support lever 72. The support arm 94*c* may be separate from the support lever 72 when the driving cams 66L and 66R are in contact with the support lever 72.

[Description of Operation of Binding Operation Unit]

FIGS. 10 to 13 are operation explanatory views of the binding operation unit in the recording-material binding device 10. The binding operation unit operates to bind recording materials by using the driving cams 66. In the description of the operation, when the left and right driving cams 66L and 66R do not need to be distinguished, they are simply referred to as driving cams 66 for simplicity.

Figure 10:
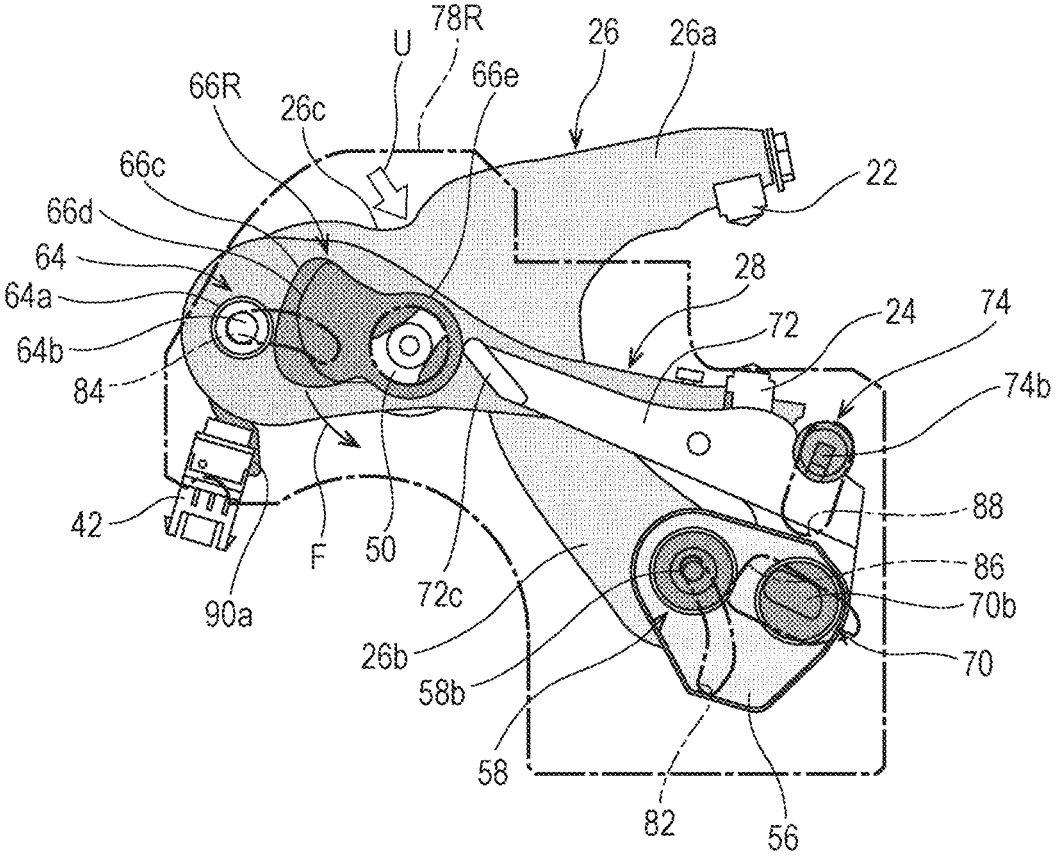
FIG. 10 is an operation explanatory view of the binding operation unit.

FIG. 10 illustrates a state in which the binding operation unit is at a home position (corresponding to an example of a retreated position). At the home position, the first cam faces 66*c* of the driving cams 66 are in contact with the shaft portion 64*a* of the arm pin 64. Thus, the first cam faces 66*c* maximally retreat the arm pin 64, and the entire binding operation unit is retreated. The upper tooth-shaped member 22 and the lower tooth-shaped member 24 are also retreated, and are most separate from each other. The connecting portion 26*b* of the upper arm 26 is pulled up until the guide projections 58*b* of the connecting pin 58 are located near upper ends of the connecting-pin guide grooves 82. Correspondingly to this position of the connecting pin 58, the guide projections 70*b* of the guide pin 70 are located at the centers of upper sides of the guide holes 86, and the guide projections 74*b* of the support bar 74 are located near upper ends of the support-lever guide groove 88. At this time, as illustrated in FIG. 7, in the home-position detector 90, the cam follower 90*b* abuts on the second cam face 66*d*, and the detection piece 90*a* is located at a detection object position of the home position sensor 42. On the basis of detection of the home position sensor 42 for the detection piece 90*a*, the controller 100 recognizes that the binding operation unit is at the home position.

When the driving cams 66 turn from the home position in a counterclockwise direction F in FIG. 10, the shaft portion 64*a* of the arm pin 64 separates from the first cam faces 66*c* at a certain position, and is brought into contact with the cam base bottom faces 66*e*.

Figure 11:
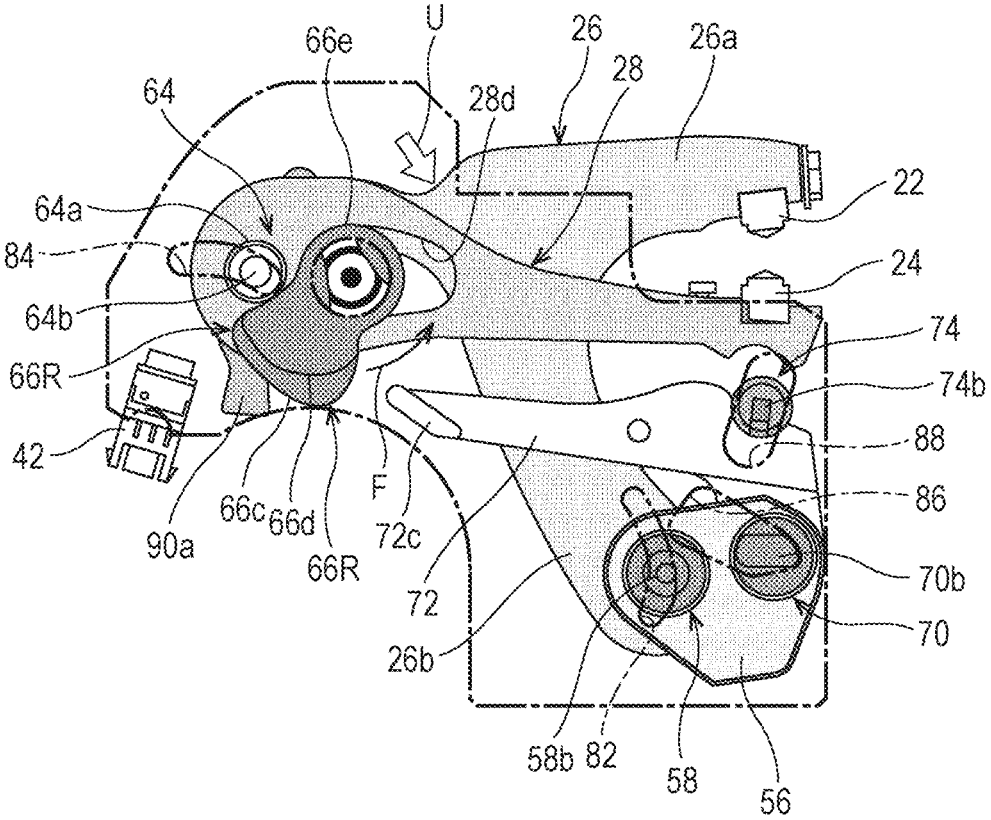
FIG. 11 is an operation explanatory view of the binding operation unit.

FIG. 11 illustrates a state immediately after the shaft portion 64*a* of the arm pin 64 separates from the first cam faces 66*c*. Since the shaft portion 64*a* and the first cam faces 66*c* are disengaged from each other, the binding operation unit is entirely pushed out to the lower front side (lower right side in FIG. 11) by a biasing force U of the push-out spring 92. A position to which the binding operation unit is pushed out corresponds to an example of a processing position (binding position). That is, the binding operation unit is moved from the home position (retreated position) to the processing position by the biasing force U of the push-out spring 92. The arm pin 64 moves frontward along the arm-pin guide grooves 84, and the upper arm 26 moves frontward along therewith. At the same time, the upper arm 26 also moves downward as the guide projections 58*b* of the connecting pin 58 at the lower end of the connecting portion 26*b* are guided downward along the connecting-pin guide grooves 82. For this reason, the upper tooth-shaped member 22 advances frontward, and also moves downward. The lower arm 28 moves frontward along with the frontward movement of the arm pin 64. Also, the lower arm 28 is guided by the cam shaft 50 penetrating the openings 28*d*, and moves almost frontward without turning. For this reason, the lower tooth-shaped member 24 also advances frontward. Since the upper tooth-shaped member 22 advances to the lower front side and the lower tooth-shaped member 24 advances frontward, the upper and lower tooth-shaped members 22 and 24 approach each other while advancing frontward. The push-out spring 92 corresponds to an example of a first pressing unit, and the force (biasing force U) of the push-out spring 92 corresponds to an example of a first force.

Since upper parts of the connecting-pin guide grooves 82 obliquely extend to the lower front side, the lever link 56 moves to the lower front side along with the movement of the connecting pin 58 along the connecting-pin guide grooves 82. However, when the guide projections 70*b* of the guide pin 70 come into contact with front edges of the guide holes 86, the lever link 56 does not further move frontward, but subsequently turns on the guide pin 70 in the counterclockwise direction. As the guide pin 70 moves to the lower front side, the support lever 72 also moves. Since the support bar 74 provided integrally with the support lever 72 moves along the support-lever guide grooves 88 that extend in a substantially up-down direction, the support bar 74 does not move frontward even when the guide pin 70 moves frontward. As illustrated in FIG. 11, the support-lever guide grooves 88 extend rearward as they extend downward. For this reason, the support lever 72 is turned in the counterclockwise direction. Thus, the cam followers 72*c* at the rear end of the support lever 72 move downward. At this time, the support spring 94 supports a rear portion of the support lever 72 from below so that the cam followers 72*c* do not excessively move.

The home-position detector 90 moves frontward together with the arm pin 64, and the detection piece 90*a* comes out of the detection object position of the home position sensor 42.

Figure 12:
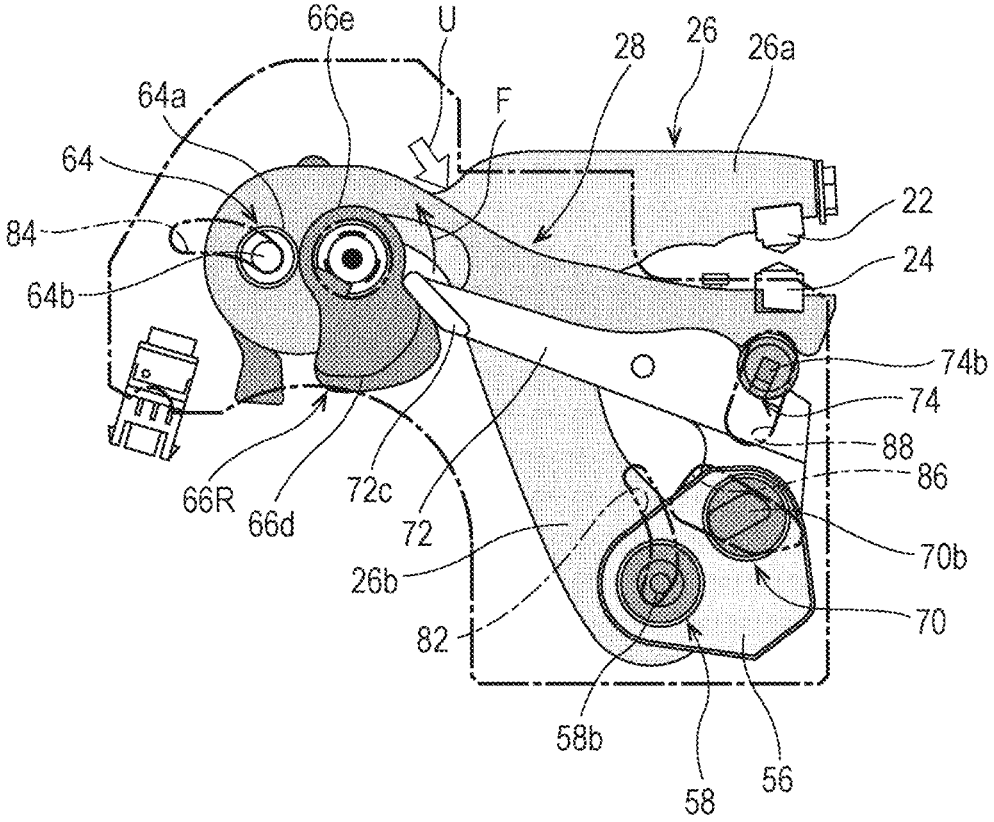
FIG. 12 is an operation explanatory view of the binding operation unit.

FIG. 12 illustrates a state in which the driving cams 66 are further turned in the counterclockwise direction F and the second cam faces 66*d* are in contact with the cam followers 72*c* of the support lever 72. The arm pin 64 is in contact with the cam base bottom faces 66*e* of the driving cams 66, and is located at a position further shifted frontward from the position of FIG. 11. Thus, the upper arm 26 also further moves to the lower front side from the state of FIG. 11, and the lower arm 28 further moves frontward. Along with the downward movement of the connecting portion 26*b* of the upper arm 26, the guide projections 58*b* of the connecting pin 58 are guided along the connecting-pin guide grooves 82. The connecting-pin guide grooves 82 are bent, and portions on a lower side of bent points extend rearward as they extend downward. Since the lower portions of the connecting-pin guide grooves 82 extend rearward, the upper arm 26 turns clockwise. The lever link 56 is pulled downward by the connecting pin 58, and turns counterclockwise because the downward movement of the guide projections 70*b* of the guide pin 70 is restricted by the guide holes 86. By the movement of the connecting pin 58 to the rear lower side and the counterclockwise turn of the lever link 56, the guide projections 70*b* of the guide pin 70 are moved to the center portions of the guide holes 86. At the same time, the guide projections 74*b* of the support bar 74 move upward along the support-lever guide grooves 88, and the support lever 72 moves upward. Since the rearward movement of the guide projections 74*b* of the support bar 74 is restricted by the support-lever guide grooves 88, when the guide pin 70 moves rearward, the support lever 72 turns on the support bar 74 in the clockwise direction. Along with the clockwise turn of the support lever 72, the cam followers 72*c* move up to a position where the second cam faces 66*d* of the driving cams 66 abut on the cam followers 72*c*. This upward movement of the cam followers 72*c* is assisted by the support spring 94. When the second cam faces 66*d* of the driving cams 66 come into contact with the cam followers 72*c* of the support lever 72, the support lever 72 is turned clockwise by further turn of the driving cams 66. Also, the support bar 74 comes into contact with the lower surface of the lower arm 28.

Figure 13:
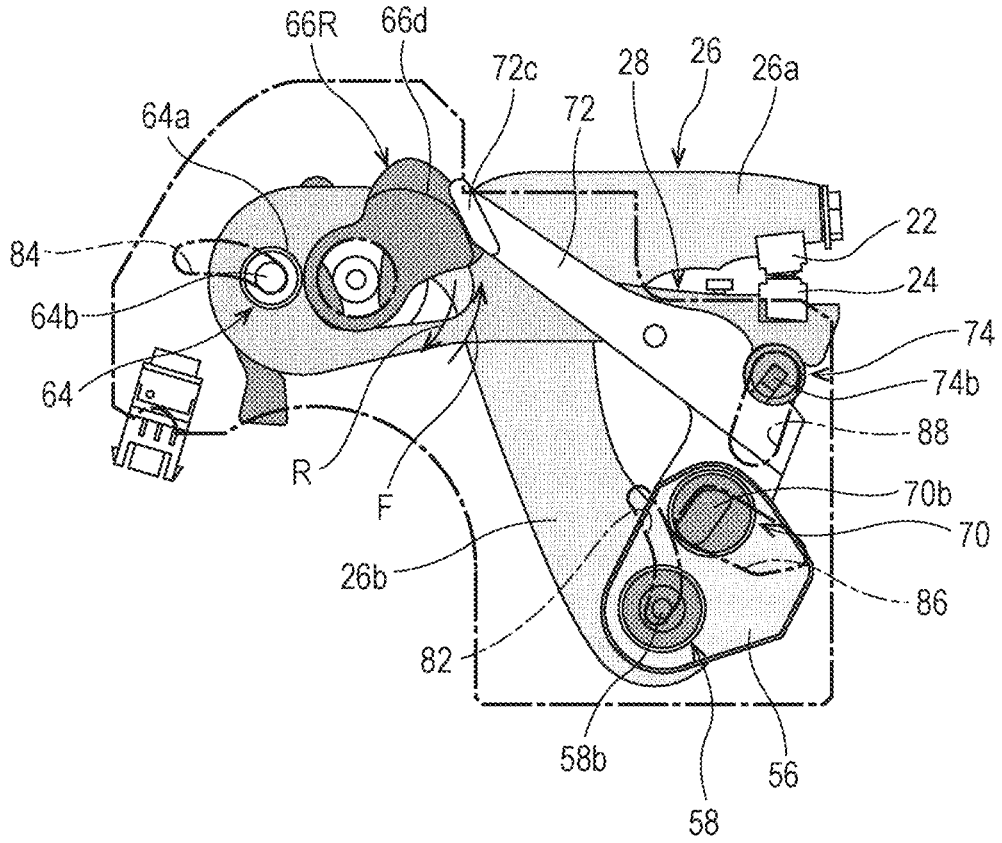
FIG. 13 is an operation explanatory view of the binding operation unit.

FIG. 13 illustrates a state in which the driving cams 66 are further turned counterclockwise and recording materials are clamped by the upper tooth-shaped member 22 and the lower tooth-shaped member 24. The cam followers 72*c* of the support lever 72 are further pushed upward from the state of FIG. 12 by the second cam faces 66*d*. On the other hand, the guide projections 74*b* of the support bar 74 reach the upper ends of the support-lever guide grooves 88, and the support lever 72 turns on the support bar 74 in the clockwise direction. Along with the turn of the support lever 72, the guide projections 70*b* of the guide pin 70 move to the rear ends of the guide holes 86, and the lever link 56 further turns counterclockwise. Through these operations, the connecting pin 58, the guide pin 70, and the support bar 74 are aligned nearly on a straight line. Also, the support bar 74 pushes up the lower arm 28 so that the upper tooth-shaped member 22 and the lower tooth-shaped member 24 bite each other.

When the upper tooth-shaped member 22 and the lower tooth-shaped member 24 bite, recording materials clamped therebetween are deformed in a wavy form, and the recording materials are joined and bound. The second cam faces 66*d* of the driving cams 66 are shaped to gradually push up the cam followers 72*c* as they turn. When the stack of recording materials is thin, it is required that the upper and lower tooth-shaped members 22 and 24 should bite deeper than when the stack is thick. Hence, the controller 100 turns the driving cams 66 more. Information about the thickness of the recording materials is input to the controller 100, for example, by the user of the image forming system 11. On the basis of this information, the turn angle (rotation amount) of the driving cams 66, that is, the rotation angle of the motor 46 is determined by the controller 100. The rotation angle of the motor 46 from the home position is detected by the encoder 54. When the rotation angle reaches a rotation angle corresponding to the thickness of the recording materials at this time, the controller 100 stops the rotation of the motor 46. When recording materials of the same thickness are used, the controller 100 may control the rotation amount of the driving cams 66 on the basis of the number of recording materials contained in the recording material bundle. For example, when the number of recording materials is small (for example, three recording materials), the controller 100 may turn the driving cams 66 more than when the number of recording materials is large (for example, ten recording materials). The driving cams 66 correspond to an example of a second pressing unit, and the force of the turn of the driving cams 66 corresponds to an example of a second force. The force of the turn of the driving cams 66 (second force) is greater than the biasing force of the push-out spring 92 (first force), and the recording materials are bound by the force of the turn of the driving cams 66.

After that, the motor 46 reverses, and the driving cams 66 turn in reverse in the clockwise direction R. When the driving cams 66 turn in reverse and reach, for example, the position of FIG. 12, the upper tooth-shaped member 22 and the lower tooth-shaped member 24 separate from each other. By the action of the upper guide plate 60 and the lower guide plate 62 disposed around the upper and lower tooth-shaped members 22 and 24, the bundle of recording materials is pulled away from the upper tooth-shaped member 22 or the lower tooth-shaped member 24. When the driving cams 66 further turn in reverse and the first cam faces 66*c* come into contact with the shaft portion 64*a* of the arm pin 64, the arm pin 64 is moved in the direction along the arm-pin guide grooves 84. With this, the binding operation unit is entirely moved to the upper rear side. When the binding operation unit returns to the position of FIG. 10 and the home position is detected by the home position sensor 42, the rotation of the motor 46 is stopped.

In the state of FIG. 11, if, for example, foreign matter gets between the upper tooth-shaped member 22 and the lower tooth-shaped member 24, a force more than or equal to a preset force is applied in a direction opposite from the direction in which the upper tooth-shaped member 22 and the lower tooth-shaped member 24 clamp the recording materials, and the distance between the upper tooth-shaped member 22 and the lower tooth-shaped member 24 is not decreased, the driving cams 66 serving as the second pressing unit do not apply any force to the binding operation unit. This operation will be described in detail. For example, when foreign matter gets between the upper tooth-shaped member 22 and the lower tooth-shaped member 24 in the state of FIG. 11, an opening therebetween is not closed. This restricts the downward movement of the connecting portion 26*b* of the upper arm 26, and the connecting portion 26*b* does not move downward. Hence, the connecting pin 58 connected to the connecting portion 26*b* is restricted from moving along the connecting-pin guide grooves 82, and does not move downward along the connecting-pin guide grooves 82. This restricts the movement of the lever link 56 illustrated in FIG. 12. That is, since the connecting pin 58 does not move downward, the lever link 56 is not pulled downward by the connecting pin 58, and does not turn counterclockwise. Since the connecting pin 58 does not downward and rearward and the lever link 56 does not turn counterclockwise, the guide projections 70*b* of the guide pin 70 do not move to the center portions of the guide holes 86.

Figure 14:
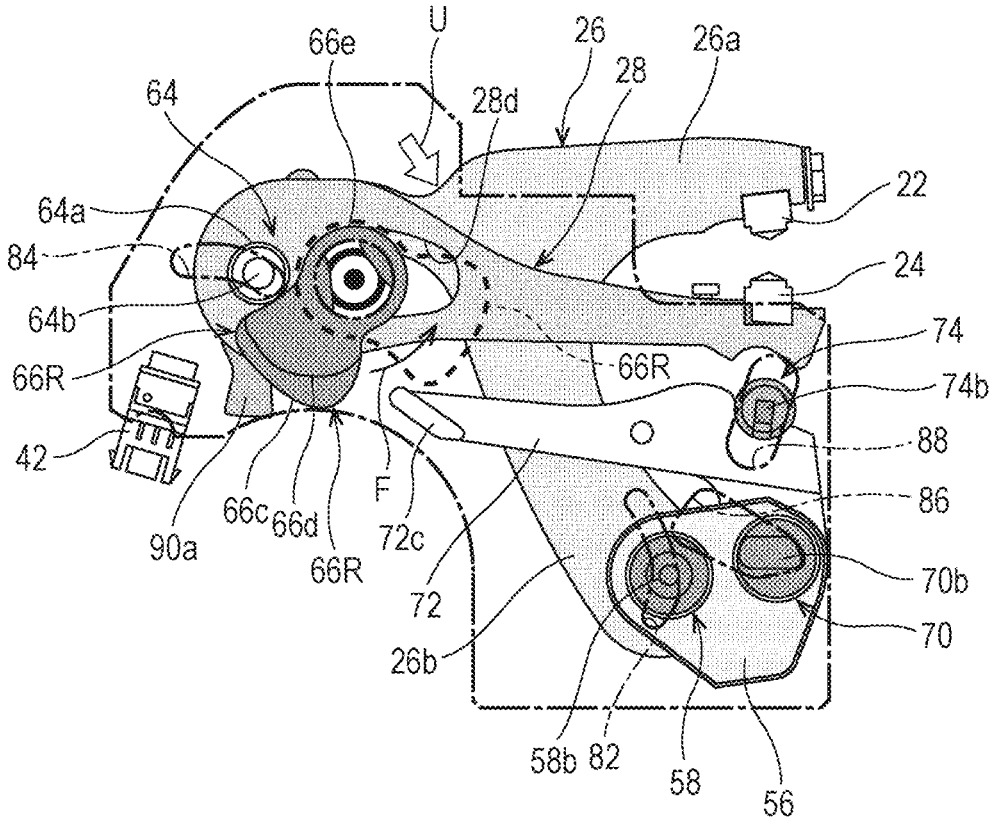
FIG. 14 is an operation explanatory view of the binding operation unit.

For this reason, the guide projections 74*b* of the support bar 74 do not move upward along the support-lever guide groove 88, and the support lever 72 does not move upward. Also, since the guide pin 70 does not move rearward, the guide projections 74*b* of the support bar 74 do not turn clockwise. For this reason, the support lever 72 does also not turn clockwise, and the cam followers 72*c* do not move up to the position where the second cam faces 66*d* of the driving cams 66 abut on the cam followers 72*c*. As a result, the second cam faces 66*d* of the driving cams 66 do not abut on the cam followers 72*c*. That is, the driving cams 66 miss the support lever 72. The driving cams 66 in the missing state are shown by a broken line in FIG. 14. The driving cams 66 (66R) shown by the broken line in FIG. 14 miss the support lever 72, and are turned to the upper side of the support lever 72. For this reason, the force of the driving cams 66 is not transmitted to the support lever 72, and the cam followers 72*c* of the support lever 72 are not pushed up from the state of FIG. 11. As a result, the upper arm 26 is not pushed down, the lower arm 28 is not pushed up, and the force (second force) of the driving cams 66 is not transmitted to the upper tooth-shaped member 22 and the lower tooth-shaped member 24. That is, the force of the driving cams 66 is not transmitted to the binding operation unit when such a force that the cam followers 72*c* do not move up to an abuttable position (position where the second cam faces 66*d* of the driving cams 66 abut on the cam followers 72*c*) is applied to the upper tooth-shaped member 22 and the lower tooth-shaped member 24 and the distance between the upper tooth-shaped member 22 and the lower tooth-shaped member 24 is not decreased.

In this way, the force of the driving cams 66 is not transmitted to the binding operation unit in the case in which, when the biasing force U (first force) of the push-out spring 92 is applied to the binding operation unit, for example, foreign matter gets between the upper tooth-shaped member 22 and the lower tooth-shaped member 24, the force greater than or equal to the preset force is applied in the direction opposite from the direction in which the upper tooth-shaped member 22 and the lower tooth-shaped member 24 clamp the recording materials, and the distance between the upper tooth-shaped member 22 and the lower tooth-shaped member 24 is not decreased. That is, in this case, the connecting pin 58, the connecting-pin guide grooves 82, the lever link 56, the guide pin 70, and the guide holes 86 function as an example of a restricting unit, do not transmit the force (second force) of the driving cams 66 to the binding operation unit, and do not further decrease the distance between the upper tooth-shaped member 22 and the lower tooth-shaped member 24.

An operation performed when, for example, foreign matter gets between the upper tooth-shaped member 22 and the lower tooth-shaped member 24 will be described from another viewpoint. In the exemplary embodiment, when the distance between the upper tooth-shaped member 22 and the lower tooth-shaped member 24 is longer than a threshold value, that is, when the distance between the upper tooth-shaped member 22 and the lower tooth-shaped member 24 corresponds to such a distance that the cam followers 72*c* do not move up to the above-described abuttable position, the force of the driving cams 66 is not transmitted to the binding operation unit. Conversely, when the distance between the upper tooth-shaped member 22 and the lower tooth-shaped member 24 is shorter than or equal to the threshold value, that is, when the distance between the upper tooth-shaped member 22 and the lower tooth-shaped member 24 corresponds to such a distance that the cam followers 72*c* move up to the above-described abuttable position, the force of the driving cams 66 is transmitted to the binding operation unit. That is, when a stack of recording materials or foreign matter having such a thickness that the cam followers 72*c* do not move up to the above-described abuttable position is placed between the upper tooth-shaped member 22 and the lower tooth-shaped member 24, that is, when a stack of recording materials or foreign matter having a thickness more than the threshold value is placed between the upper tooth-shaped member 22 and the lower tooth-shaped member 24, the force of the driving cams 66 is not transmitted to the binding operation unit. Conversely, when a stack of recording materials having such a thickness that the cam followers 72*c* move up to the abuttable position is placed between the upper tooth-shaped member 22 and the lower tooth-shaped member 24, that is, when a stack of recording materials having a thickness less than or equal to the threshold value is placed between the upper tooth-shaped member 22 and the lower tooth-shaped member 24, the force of the driving cams 66 is transmitted to the binding operation unit.

In this way, when the opening amount of the opening formed by the upper tooth-shaped member 22 and the lower tooth-shaped member 24 (distance between the upper tooth-shaped member 22 and the lower tooth-shaped member 24) is less than or equal to the threshold value, the force (second force) of the driving cams 66 serving as the second pressing unit is transmitted to the binding operation unit, and the recording materials are bound by the second force. In contrast, when the opening amount (distance between the upper tooth-shaped member 22 and the lower tooth-shaped member 24) is more than the threshold value, the force (second force) of the driving cams 66 is not transmitted to the binding operation unit. In this way, the driving cams 66 serving as the transmission member transmit the force to the binding operation unit when the opening amount is less than or equal to the threshold value, but do not transmit the force to the binding operation unit when the opening amount is more than the threshold value.

From a further viewpoint, when the opening amount is less than or equal to the threshold value, the driving cams 66 are in contact with the cam followers 72*c* of the support lever 72 serving as the intermediate member, and therefore, the force (second force) of the driving cams 66 is transmitted to the binding operation unit. That is, when a stack of recording materials having such a thickness that the opening amount is less than or equal to the threshold value is placed between the upper tooth-shaped member 22 and the lower tooth-shaped member 24, the driving cams 66 are in contact with the cam followers 72*c* of the support lever 72, and therefore, the force of the driving cams 66 is transmitted to the binding operation unit. In contrast, when the opening amount is more than the threshold value, the driving cams 66 are not in contact with the cam followers 72*c*, and therefore, the force of the driving cams 66 is not transmitted to the binding operation unit. That is, when a stack of recording materials or foreign matter having such a thickness that the opening amount is more than the threshold value is placed between the upper tooth-shaped member 22 and the lower tooth-shaped member 24, the force of the driving cams 66 is not transmitted to the binding operation unit.

From a still further viewpoint, when the opening amount is less than or equal to the threshold value, the cam followers 72*c* of the support lever 72 are placed in the orbits of the turning motions of the driving cams 66. Thus, the driving cams 66 are in contact with the cam followers 72*c*, and the force of the driving cams 66 is transmitted to the binding operation unit. That is, when a stack of recording materials having such a thickness that the opening amount is less than or equal to the threshold value is placed between the upper tooth-shaped member 22 and the lower tooth-shaped member 24, the cam followers 72*c* of the support lever 72 are disposed in the orbits of the turning motions of the driving cams 66. In contrast, when the opening amount is more than the threshold value, the cam followers 72*c* of the support lever 72 are located out of the orbits of the turning motions of the driving cams 66. Thus, the driving cams 66 are not in contact with the cam followers 72*c*, and the force of the driving cams 66 is not transmitted to the binding operation unit. That is, when a stack of recording materials or foreign matter having such a thickness that the opening amount is more than the threshold value is placed between the upper tooth-shaped member 22 and the lower tooth-shaped member 24, the cam followers 72*c* of the support lever 72 are located out of the orbits of the turning motions of the driving cams 66.

The upper arm 26 and the lower arm 28 correspond to a pivot member that pivots on the shaft portion 64*a* (pivot) of the arm pin 64. The driving cams 66 corresponding to a transmission member that transmits a force for pivoting the upper arm 26 and the lower arm 28. The support lever 72 and the lever link 56 are members that constitute an intermediate member, and transmit the force from the driving cams 66 as a pressure, with which the upper tooth-shaped member 22 and the lower tooth-shaped member 24 clamp the recording materials, to the upper arm 26 and the lower arm 28 included in the binding operation unit. The lever link 56 corresponds to a link member that converts the force of the turning motions of the driving cams 66 into a force for causing the upper arm 26 and the lower arm 28 to approach each other, that is, a force for causing the upper tooth-shaped member 22 and the lower tooth-shaped member 24 to approach each other. That is, the intermediate member converts the force from the driving cams 66 into a force acting in a direction different from the direction in which the driving cams 66 press the support lever 72, and transmits the converted force to the upper arm 26 and the lower arm 28.

When the cam followers 72*c* of the support lever 72 are in contact with the driving cams 66 to transmit the force from the driving cams 66 to the upper arm 26 and the lower arm 28, as illustrated in FIG. 13, the driving cams 66 are held between the shaft portion 64*a* of the arm pin 64 (corresponding to an example of a shaft member) and the support lever 72. Thus, a reaction force generated when a pressure in the binding direction is applied to the binding operation unit is received by the driving cams 66 that apply the pressure to the binding operation unit. That is, when the driving cams 66 are held between the shaft portion 64*a* disposed at the pivot and the support lever 72, the force of the shaft portion 64*a* of the arm pin 64 for pressing the driving cams 66 and the force of the support lever 72 for pressing the driving cams 66 are canceled each other. More specifically, since the shaft portion 64*a* of the arm pin 64 presses the driving cams 66 from the rear side toward the front side and the support lever 72 presses the driving cams 66 from an opposite direction (the support lever 72 presses the driving cams 66 from the front side toward the rear side), the driving cams 66 receive the forces from the opposite directions. Thus, the forces from the opposite directions are cancelled in the driving cams 66. Since cancelling of the forces is completed inside the binding operation unit, the force (reaction force) applied to the support member in the binding operation unit (for example, the frame such as the left side frame 40L and the right side frame 40R) becomes smaller than when cancelling of the forces is not completed inside the binding operation unit.

As a comparative example, the cam shaft 50 (turn shaft) of the driving cams 66 and the turn shaft of the binding operation unit (shaft portion 64*a*) may be the same shaft. In this case, since the force of the shaft portion 64*a* of the arm pin 64 for pressing the driving cams 66 and the force of the support lever 72 for pressing the driving cams 66 are also canceled at the cam shaft 50, canceling of the forces is completed inside the binding operation unit, and the force (reaction force) applied to the support member in the binding operation unit is reduced.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing device comprising:

a binding mechanism comprising two pivot members opposed to each other, wherein the two pivot members are configured to pivot on a pivot and bind sheets with a pressure by clamping the sheets between the two pivot members;

a transmission member comprising a cam, wherein the transmission member is configured to transmit force to pivot the two pivot members; and an intermediate member comprising a lever, wherein the intermediate member is configured to transmit, to the binding mechanism, force from the transmission member as the pressure with which the two pivot members clamp the sheets, wherein the sheet processing device is configured such that, when the intermediate member is in contact with the transmission member to transmit force from the transmission member to the binding mechanism, the transmission member is held between the intermediate member and a shaft provided at the pivot of the binding mechanism.

2. The sheet processing device according to claim 1, wherein the cam is configured to turn on a turn center of the transmission member, and wherein the intermediate member includes a lever link configured to convert force of a turning motion of the cam into force for causing the two pivot members to approach each other at a binding position for the sheets.

3. The sheet processing device according to claim 2, wherein the cam is configured to transmit force to the intermediate member by pressing the intermediate member, wherein the intermediate member is configured to convert force from the cam into force acting in a different direction different from a direction in which the cam presses the intermediate member, and to transmit the converted force to the binding mechanism, and wherein the force acting in the different direction is a force acting in a direction in which the two pivot members are caused to approach each other at the binding position.

4. The sheet processing device according to claim 3, wherein the force transmitted to the binding mechanism by the intermediate member is proportional to a turning amount of the cam.

5. The sheet processing device according to claim 4, wherein the force transmitted to the binding mechanism by the intermediate member increases as the turning amount of the cam increases.

6. The sheet processing device according to claim 2, wherein the force transmitted to the binding mechanism by the intermediate member is proportional to a turning amount of the cam.

7. The sheet processing device according to claim 6, wherein the force transmitted to the binding mechanism by the intermediate member increases as the turning amount of the cam increases.

8. The sheet processing device according to claim 1, wherein the binding mechanism is configured to bind the sheets without staples.

9. The sheet processing device according to claim 1, wherein the two pivot members are configured to pivot on the pivot and bind the sheets with the pressure by clamping the sheets between the two pivot members as the two pivot members move in up/down directions, and wherein the sheet processing device is configured such that, when the intermediate member is in contact with the transmission member to transmit force from the transmission member to the binding mechanism, the transmission member is held between the intermediate member and the shaft in right-left directions.

10. The sheet processing device according to claim 1, wherein the sheet processing device is configured such that, when the intermediate member is in contact with the transmission member to transmit force from the transmission member to the binding mechanism, the shaft presses the transmission member in a first direction and the intermediate member presses the transmission member in a second direction that is opposite to the first direction.

11. The sheet processing device according to claim 10, wherein the sheet processing device is configured such that, when the intermediate member is in contact with the transmission member to transmit force from the transmission member to the binding mechanism, a first force of the shaft pressing the transmission member in the first direction cancels a second force of the intermediate member pressing the transmission member in the second direction.

12. The sheet processing device according to claim 1, wherein the sheet processing device is configured such that, when the intermediate member is in contact with the transmission member to transmit force from the transmission member to the binding mechanism, the transmission member is held between the intermediate member and the shaft such that a line passing through the pivot and a rotational axis of the transmission member also passes through the intermediate member.

13. The sheet processing device according to claim 1, wherein the sheet processing device is configured such that the pressure clamping the sheets between the two pivot members generates a reaction force that is applied to the transmission member in a first direction, and wherein the sheet processing device is configured such that the reaction force is opposed by an opposing force applied by the shaft to the transmission member in a second direction opposite to the first direction.

14. An image forming system comprising:

an image forming apparatus configured to form an image on at least one sheet from among a plurality of sheets; and a sheet processing device configured to conduct a processing on sheets, wherein the sheet processing device comprises:

a binding mechanism comprising two pivot members opposed to each other, wherein the two pivot members are configured to pivot on a pivot and bind the sheets with a pressure by clamping the sheets between the two pivot members, a transmission member comprising a cam, wherein the transmission member is configured to transmit force to pivot the two pivot members, and an intermediate member comprising a lever, wherein the intermediate member is configured to transmit, to the binding mechanism, force from the transmission member as the pressure with which the two pivot members clamp the sheets, and wherein the sheet processing device is configured such that, when the intermediate member is in contact with the transmission member to transmit force from the transmission member to the binding mechanism, the transmission member is held between the intermediate member and a shaft provided at the pivot of the binding mechanism.

* * * * *